United States Patent [19]

Keeton

[11] Patent Number: 4,649,840

[45] Date of Patent: Mar. 17, 1987

[54] AUTOMATIC REMOVAL AND STACKING OF SEWN GARMENTS

[76] Inventor: J. Herbert Keeton, 727 Meader Dr., Box 296, Campbellsville, Ky. 42718

[21] Appl. No.: 707,371

[22] Filed: Mar. 1, 1985

[51] Int. Cl.[4] ..... D05B 33/00

[52] U.S. Cl. ..... 112/121.29; 112/288; 112/304; 271/83; 271/70; 414/80

[58] Field of Search ..... 414/80; 271/83, 66, 271/70, 72, 186; 112/121.29, 288, 262.3, 121.12, 304

[56] References Cited

U.S. PATENT DOCUMENTS

| | | | |
|---|---|---|---|
| 3,389,906 | 6/1968 | Walton | 271/70 |
| 3,599,584 | 8/1971 | Fowler | 112/121.29 X |
| 3,610,186 | 10/1971 | Murdter | 112/121.29 |
| 3,726,240 | 4/1973 | Emich | 112/121.29 X |
| 3,741,052 | 6/1973 | Frost et al. | 112/121.29 X |
| 4,286,907 | 9/1981 | Houle et al. | 271/83 X |
| 4,519,331 | 5/1985 | Kosrow et al. | 112/121.29 X |
| 4,524,706 | 6/1985 | Bell | 112/121.29 |

*Primary Examiner*—Werner H. Schroeder
*Assistant Examiner*—Andrew M. Falik
*Attorney, Agent, or Firm*—Cushman, Darby & Cushman

[57] ABSTRACT

Efficient stacking of sheets, such as garments, is practiced utilizing a stacker which includes a number of rods slidably received in parallel through-extending openings in an elongated support, the openings being generally perpendicular to the dimension of elongation of the support. The support is rotated about an axis coincident with the dimension of elongation in 180° increments. The support is positioned so that the rods move in an arcuate path through spaces between parallel slats which support a garment, to move the garment from being supported by the slats and to stack it in a pile adjacent the slats. Once the rods have been moved to a position stacking the garment, they are powered by a roller so that they move linearly with respect to the support, through the openings in the support, until they are again positioned below the slat openings and await the next garment. The stacker is preferably positioned immediately adjacent an automatic sewing machine, with conveying belts automatically moving the garment away from the automatic sewing machine to the slats. The slats preferably comprise a slide, being positioned so that they slope downwardly from the conveyor belts toward the stack of garments.

11 Claims, 3 Drawing Figures

AUTOMATIC REMOVAL AND STACKING OF SEWN GARMENTS

BACKGROUND OF THE INVENTION

1. Field of the Invention

The present invention relates to sheet handling apparatus and, particularly, for apparatus for receiving from a continuously operating conveyor a sequence of discrete sheet articles such as clothing and which moves each article from the conveyor to another position where the articles are stacked in a pile.

2. Description of Related Art

In the garment industry, there are numerous occasions when it is desirable to move garments from an operating station and then stack them in a position adjacent the operating station, so that they can subsequently be removed and acted upon again. (The term "garment" as used in the present specification and claims means pieces of garments, and cloth, as well as substantially complete garments.) According to the present invention, a simple and effective apparatus is provided for effecting such stacking. The apparatus is very versatile, being utilizable in a number of different operations during garment manufacture, and in fact having general applicability to situations where sheets of material are to be moved from one position, and stacked in a pile.

The invention is particularly adapted to be used in conjunction with an automatic sewing machine. The automatic sewing machine is conventionally mounted on a table, or like flat surface, and according to the invention a plurality of conveyor belts are mounted just above the flat surface to automatically convey garments away from the automatic sewing machine in a generally horizontal and linear path. An electric eye sensor, or the like, can sense the position of a thread connecting the garment to the automatic sewing machine, and operate a knife for automatically severing the thread. Adjacent the ends of the conveyor belts is a slide, comprising a plurality of slats which slant downwardly from the conveyor belts toward a pile of stacked garments. The stacker according to invention cooperates with the slats of the slide to move garments from the slide and stack them in the pile.

The stacker comprises a plurality of rods, and an elongated support having a plurality of generally parallel through-extending openings, the openings extending generally perpendicularly to the dimension of elongation of the support. The openings have slightly larger cross-sectional dimensions than the cross-sectional dimensions of the rods, and the rods are received in and extend through the openings in slidable relationship with the support. The rods have enlarged ends so that they cannot move completely through the openings. The support is rotated about an axis coincident with its dimension of elongation, in 180° increments, and the support is positioned so that the rods move in an arcuate path through the spaces between the slats during rotation of the support, to engage the garments and stack them adjacent the slide. Rotation of the support is effected automatically upon sensing of the position of the garment on the slide.

After each 180° incremental rotation of the support, the rods are engaged by a powered roller and move linearly through the openings in the support to a position wherein they are again below the spaces between the slats.

It is the primary object of the present invention to provide a simple and effective sheet stacking apparatus, particularly one adapted for stacking garments that are conveyed away from a sewing station. This and other objects of the invention will become clear from an inspection of the detailed description of the invention and from the appended claims.

DETAILED DESCRIPTION OF THE DRAWINGS

Figure 1:
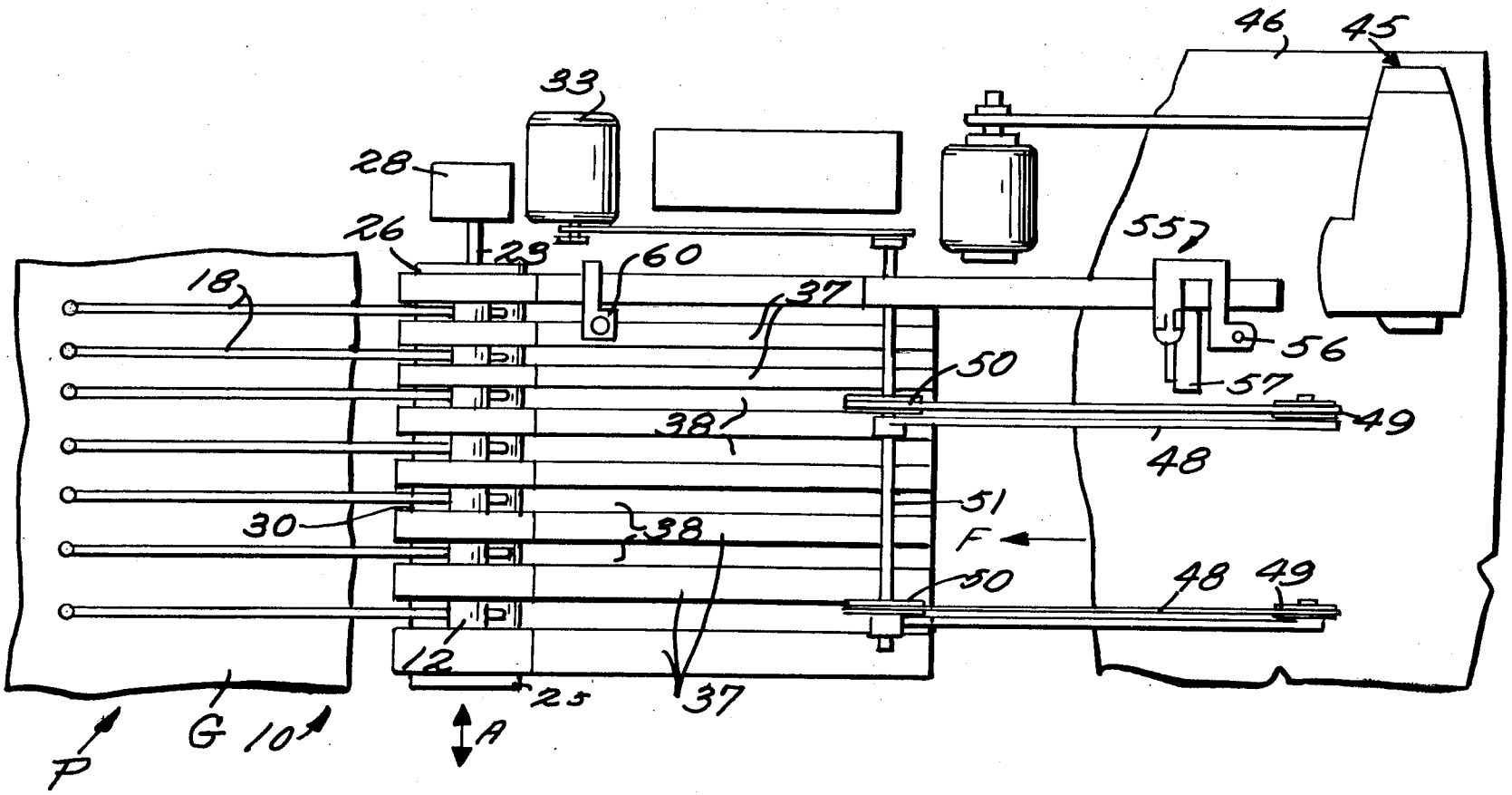
FIG. 1 is a top plan view of an exemplary apparatus for conveying and stacking garments, according to the present invention, shown in operative association with an automatic sewing machine.
Figures 2, 3:
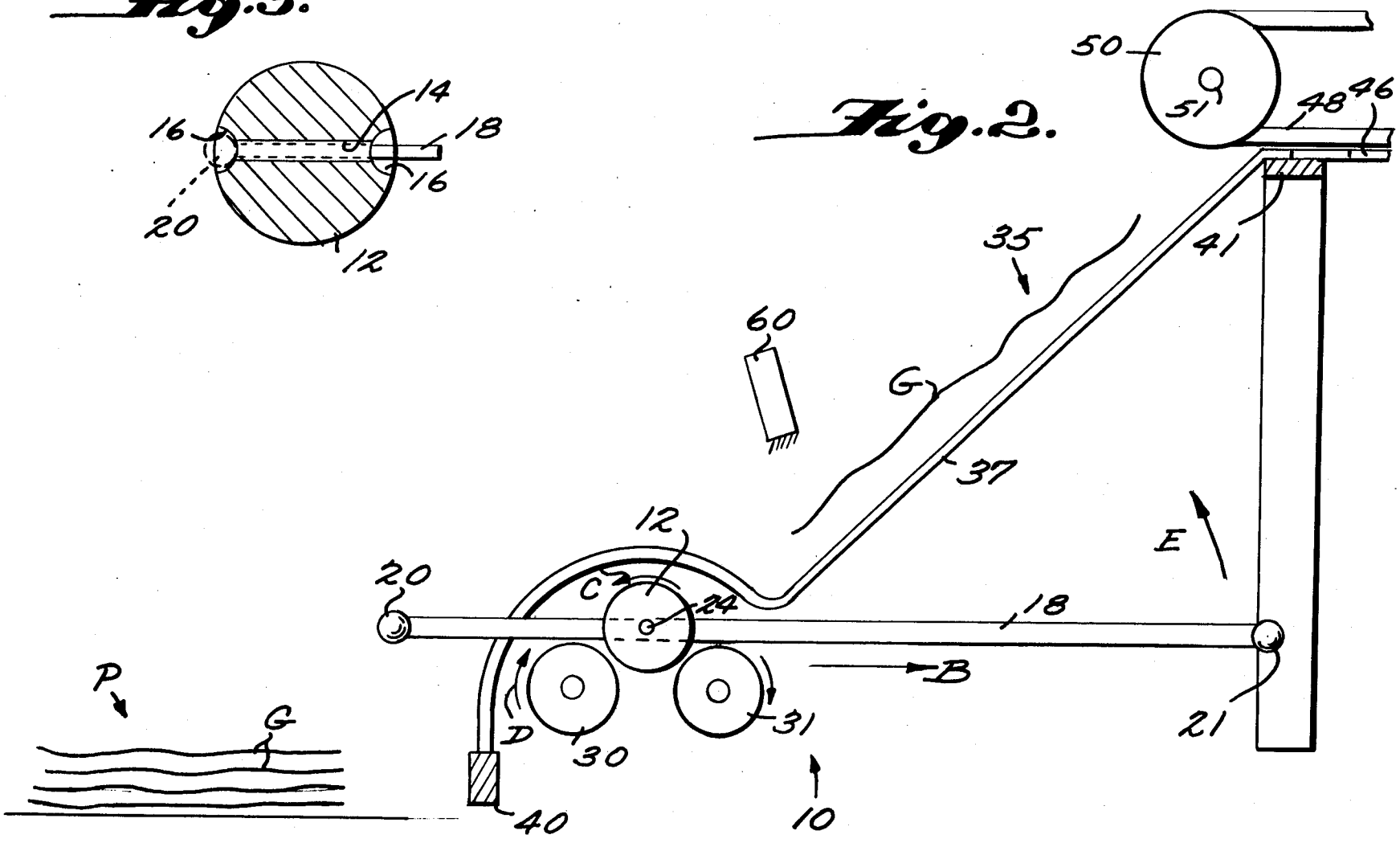
FIG. 2 is a side view, partly in cross-section and partly in elevation, of the automatic stacker of FIG. 1 shown in cooperation with the slide of FIG. 1 and garments stacked in a pile.
FIG. 3 is a detail cross-sectional view of the elongated support of the stacker of FIGS. 1 and 2, with a rod in association therewith shown in dotted line.

An exemplary sheet stacking apparatus according to the present invention is shown generally by reference numeral 10 in FIGS. 1 and 2, and a detail of a component thereof is illustrated in FIG. 3. The sheet stacking apparatus, which is particularly adapted for use with garments, although not restricted to use with garments, includes as one of the major components thereof a support 12 which is elongated in a dimension of elongation A—A. In the embodiment illustrated in the drawings, the support 12 is shown as a cylindrical structure, although it could have other shapes. The support has a plurality of generally parallel through-extending openings formed therein. One such opening can be seen in FIG. 3, and is illustrated by reference numeral 14. Preferably associated with each opening 14, as illustrated in FIG. 3, there are enlarged portions 16 at each end of each opening 14.

Another major component of the stacking apparatus 10 comprises a plurality of rods 18. The rods preferably are of a relatively rigid material, such as metal or a relatively rigid plastic, and are dimensioned so that they slidingly fit in the openings 14. In the embodiment illustrated in the drawings, the rods 18 are circular in cross-section, and the opening 14 is circular in cross-section, the opening 14 having cross-sectional dimensions (e.g. diameter) slightly greater than the corresponding cross-sectional dimensions (e.g. diameter) of the rods 18. The rods 18 are linearly slidable in the support 12, as indicated by the arrow B in FIG. 2. Means are provided for preventing the rods 18 from passing completely out of the openings 14, and such means preferably take the form of the enlarged end portions 20, 21, as illustrated most clearly in FIGS. 2 and 3. The enlarged portions 20, 21 have cross-sectional dimensions greater than those of the opening 14. Preferably one of the enlarged end portions is readily removable to facilitate ease of assembly of the rods 18 with the support 12, such as by providing the enlarged end 21 as a cap having an interior screw threading corresponding to an exterior screw threading on the end of the rod 18 with which it cooperates.

The support 12 is mounted for rotation about a horizontal axis that is coincident with the dimension of elongation A—A of the support 12. The support 12 is mounted for rotation by shaft portions 23, 24 extending outwardly from either end thereof, the shaft portion 23 (see FIG. 2) being received in a stationarily mounted bearing 25 (see FIG. 1). The shaft portion 24 is also received in a bearing, bearing 26 illustrated in FIG. 1. Also means are provided for rotating the support about its axis, the rotating means comprising a powered means 28 shown schematically in FIG. 1 and operatively connected to the shaft 23. The powered means 28 is of the type that can provide about 180° incremental rotation of the support 12. Any suitable conventional structure that can provide that function may be utilized, such as a rotary air cylinder which is connected by a one-way bearing to the shaft portion 23. For each operation of the rotating means 28, then, the support 12 will be rotated 180° in the counter-clockwise direction (see arrow C in FIG. 2) and then will stop in that position, to be rotated another 180° in the counter-clockwise direction upon the next actuation of the rotating means 28, etc.

FIG. 2 illustrates the rods 18 as they are being moved with respect to the support 12 in the direction B. FIG. 1 illustrates the rods 18 immediately after an actuation of the rotating means 28 before they are being moved in the direction B. FIG. 3 shows a rod 18 in dotted line when it is in position ready for another actuation of the means 28, with the enlarged head 20 thereof received within the recess 16 so that only a very small portion of it (e.g. about $\frac{1}{3}$) extends outwardly from the support 12.

The sheet stacking apparatus also preferably comprises powered means for effecting linear movement of the rods 18 with respect to the support 12 in the direction B, as illustrated in FIG. 2. Such means preferably take the form of a powered roller 30 and idler roller 31. They are both mounted for rotation about axes parallel to the axis of rotation of the support 12, and disposed below the support 12 on either side thereof, as illustrated in FIG. 2. The roller 30 is continuously powered by any suitable source, such as the geared motor illustrated schematically by reference numeral 33 in FIG. 1, which is connected by any suitable conventional drive mechanism (not shown) to the roller 30 for effecting continuous powered rotation thereof in the clockwise direction, as illustrated by arrow D in FIG. 2. The rollers 30, 31 are positioned with respect to the rods 18 and support 12, as illustrated in FIG. 2, so that when a portion of the rod 12 is on the left-hand side (as viewed in FIG. 2) of the support 12, the rubber exterior surface of the roller 30 will engage the rod and slide it in the direction B through the opening 14. The idler roller 31 merely acts as a support for the rod to guide its movement in the direction B so that there is no binding of the rod 18 in the opening 14.

The stacker 10 according to the invention cooperates with a sheet support means. The sheet support means in the exemplary embodiment illustrated in the drawings is in the form of a slide shown generally by reference numeral 35, although for some uses it may be flat, or have other configurations. The support means 35 comprises a plurality of slats 37 spaced from each other in a dimension parallel to the dimension of elongation A—A, having spaces 38 therebetween. The spaces 38 are parallel to and aligned with the rods 18 so that as the rods 18 are rotated by the rotating means 28 in an arcuate path E (see FIG. 2), they pass through the spaces 38 and thus do not interfere with the solid slats 37 of the slide 35. The slide slats 37 preferably are of stainless steel, or a like metal, and are affixed to supporting structures at the ends thereof, as indicated generally by reference numerals 40 and 41 in FIG. 2.

While the stacker 10 and sheet support means 35 can be utilized with a wide variety of different types of sheets and in a wide variety of processes, one particularly suitable use therefor is in association with an automatic sewing machine, illustrated schematically in FIG. 1 and identified by reference numeral 45, and powered by motor 47. The sewing machine 45, which may comprise any conventional type such as a Union Special, is mounted on a table, or other flat support, 46. The operator moves garments from one side of the machine 45 to the other (from top to bottom as viewed in FIG. 1) and after the garment is sewn it is desirable for the operator to have a way to automatically effectively stack the garments in a pile. This is facilitated, according to the present invention, by providing the rubber conveyor belts 48 which are operatively mounted to pulleys 49, 50, with the pulleys 50 being powered by rotation of the shaft 51 associated therewith. The belts 48, as may be seen in FIG. 2, are mounted so that they are slightly spaced from the flat surface 46, and so that when a garment is placed into the space between the belts 48 and the surface 46 the garment is moved in direction F (see FIG. 1). The shaft 51 preferably is powered by the same geared motor 33 as powers the roller 30, with a different conventional structure (such as a belt, chain and sprocket arrangement, etc.) for connecting the shaft 51 to the output shaft from the motor 33.

Most automatic sewing machines 45 have a structure associated therewith for automatically severing the thread extending between the garment and the sewing machine once sewing of the garment has been completed. However for sewing machines that do not, the structure illustrated generally by reference numeral 55 in FIG. 1 is provided. This structure includes an electric eye 56, or like automatic sensing means, for sensing thread interconnected between a garment received by the belts 48 and the sewing machine 45, and a conventional knife cutting arrangement 57 for automatically severing the thread in response to sensing by the electric eye 56.

Preferably the rotating means 28 is also actuated in response to an automatic sensing structure. An electric eye 60, or like automatic sensing means, is preferably mounted above the slide 35 to sense when a garment G (see FIG. 2) has been deposited on the slide 35, to effect operation of the rotating means 28 in response thereto. Any suitable conventional controls and electrical or other interconnections can be provided between the sensor 60 and the rotating means 28.

Exemplary apparatus according to the invention having been described, a conventional manner of operation thereof will now be set forth:

Operation

An operator sitting at the sewing machine 45 sews a garment, and after sewing need only move the garment a few inches in direction F so that the garment is disposed between the moving rubber conveyor belts 48 and the top of the flat surface 46. As the garment is powered by the belts 48 in direction F, any thread interconnecting the garment to the sewing machine 45 is sensed by the electric eye 56, which causes actuation of the knife assembly 57 to sever the thread.

Once the garment gets to approximately the position of the pulley 50, it starts to move down the stainless steel slats 37 of the slide 35, under the force of gravity. This movement is sensed by the automatic sensor 60, which causes actuation of the rotating means 28. At this particular time, all of the rods 18 will be in their rightmost position (as viewed in FIG. 2), so that the enlarged ends 20 thereof do not interfere with the roller 30, and the rods 18 will then move in arcuate path E so that they pass in the spaces 38 between the slats 37 and engage the garment G on the slide 35. They will then carry the garment G with them through their entire arcuate path (the total arcuate path being about 180°), the rods 18 moving with sufficient angular velocity so that the garment G is retained in contact therewith until the garment G is immediately over the pile P (see FIG. 1) of garments G adjacent, but horizontally spaced from, the slide 35. The garment G will then automatically fall into proper positioning on the pile P. At this time, the rods 18 are in the position illustrated in FIG. 1, and have been moved into contact with peripheral surface of the powered rubber roller 30. The roller 30 engages the rods 18, and moves them linearly in direction B so that they slide in the openings 14 until they reach the position illustrated in dotted line in FIG. 3 whereat the roller 30 is no longer in engagement therewith. The idler roller 31 guides the linear movement of the rods 18.

Once the rods 18 are below the slats 37, again, they are then ready for the next incremental operation of the stacker 10, which will occur when the next garment G is on the slide 35 and is sensed by the sensing means 60.

It will thus be seen that according to the present invention a simple and effective stacking apparatus, particularly one adapted for stacking garments that are conveyed away from a sewing station, has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Sheet stacking apparatus comprising:

a plurality of rods;

an elongated support elongated in a dimension of elongation and having a plurality of generally parallel through-extending openings therein, the openings extending generally perpendicularly to the dimension of elongation of said support and said openings each being larger in cross-sectional dimensions than the cross-sectional dimensions of each of said rods;

said rods received in and extending through said openings, each rod in slidable relationship with an opening;

means for preventing the rods from passing completely out of said openings; and means for rotating said support about an axis coincident with the dimension of elongation of said support;

said apparatus further comprising sheet support means comprising a plurality of slats having a space between adjacent said slats with said slats extending in a dimension parallel to said dimension of elongation of said support to provide said spaces therebetween; said rods and support being positioned with respect to said slats so that said rods pass through the spaces between said slats from beneath said slats as said rods move through an arcuate path in response to the rotation of said support by said rotating means; said rotating means comprising means for effecting incremental rotary movement of said support about 180° upon each actuation of said rotating means; and powered means for effecting linear movement of said rods with respect to said support to return said rods to a position below said slats after each actuation of said rotating means.

2. Apparatus as recited in claim 1 wherein said powered means comprises a powered roller rotatable about an axis parallel to the axis of rotation of said support, and mounted so that the axis of rotation of said powered roller is below, and horizontally spaced from, the axis of rotation of said support.

3. Apparatus as recited in claim 2 wherein said powered means further comprises an idler roller rotatable about an axis parallel to the axis of rotation of said support, and positioned at approximately the same vertical level as said powered roller, and horizontally spaced from said support on the opposite side of said support axis of rotation from said powered roller axis of rotation.

4. Apparatus as recited in claim 2 wherein said means preventing said rods from passing completely out of said openings comprise an enlarged end portions of said rods.

5. Apparatus as recited in claim 4 further comprising means defining a recess adjacent each end of each of said through-extending openings in said support, said recesses for receipt of said enlarged ends of said rods so that said rods will not interfere with said powered roller during rotation of said support.

6. Apparatus as recited in claim 1 further comprising sensing means for automatically sensing the position of a sheet in a predetermined position on said sheet support means, and for actuation of said support rotating means in response to said sensing.

7. Apparatus for conveying garments away from a sewing machine, and stacking the garments in a pile, comprising:

conveying means for positioning adjacent a sewing machine;

slide means positioned on the opposite side of said conveying means from the sewing machine, and positioned for receiving garments from said conveying means; and stacking means cooperating with said slide means for automatically removing garments from said slide means and stacking said garments in a pile adjacent, but spaced from, said stacking means;

said slide means comprising a plurality of parallel slats spaced from each other in a first horizontal dimension to define spaces therebetween, and slanting downwardly from a position adjacent said conveying means to a position adjacent the pile of garments;

said stacking means comprising:

a plurality of rods;

an elongated support elongated in a dimension of elongation and having a plurality of generally parallel through-extending openings therein, the openings extending generally perpendicularly to the dimension of elongation of said support and said openings each being larger in cross-sectional dimensions than the cross-sectional dimensions of each of said rods;

said rods received in and extending through said openings, each rod in slidable relationship with an opening;

means for preventing the rods from passing completely out of said openings;

means for rotating said support about an axis coincident with the dimension of elonglation of said support; and said elongated support positioned so that the dimension of elongation thereof is parallel to said first dimension, and so that said rods are in alignment with the spaces between said slats and move through said slat spaces, from beneath the slats, in an arcuate path upon rotation of said elongated support by said rotating means;

said rotating means comprising means for effecting incremental rotary movement of said support about 180° upon each actuation of said rotating means; said apparatus further comprising powered means for effecting linear movement of said rods with respect to said support to return said rods to a position below said slats after each actuation of said rotating means.

8. Apparatus as recited in claim 7 wherein said conveying means comprises: a flat surface part of, or coincident with, a support for the sewing machine; and a plurality of conveyor belts mounted slightly above said flat surface and for engaging garments on said flat surface and moving the garments along said flat surface while the garments are between said conveying belts and said flat surface.

9. Apparatus as recited in claim 7 further comprising sensing means for automatically sensing the position of a garment on said slide and for effecting automatic operation of said stacking means in response to said sensing, so that said stacking means remove the garment from said slide and stack it in the pile of garments.

10. Apparatus as recited in claim 7 wherein said powered means comprises: a powered roller rotatable about an axis parallel to the axis of rotation of said support, and mounted so that the axis of rotation of said powered roller is below, and horizontally spaced from, the axis of rotation of said support; and an idler roller rotatable about an axis parallel to the axis of rotation of said support, and positioned at approximately the same vertical level as said powered roller, and horizontally spaced from said support on the opposite side of said support axis of rotation from said powered roller axis of rotation.

11. Sheet stacking apparatus comprising:

a plurality of rods;

an elongated support elongated in a dimension of elongation and having a plurality of generally parallel through-extending openings therein, the openings extending generally perpendicularly to the dimension of elongation of said support and said openings each being larger in cross-sectional dimensions than the cross-sectional dimensions of each of said rods;

said rods received in and extending through said openings, each rod in slidable relationship with an opening;

means for preventing the rods from passing completely out of said openings; and means for rotating said support about an axis coincident with the dimension of elongation of said support;

said apparatus further comprising sheet support means comprising a plurality of slats having a space between adjacent said slats with said slats extending in a dimension parallel to said dimension of elongation of said support to provide said spaces therebetween; said rods and support being positioned with respect to said slats so that said rods pass through the spaces between said slats from beneath said slats as said rods move through an arcuate path in response to the rotation of said support by said rotating means; said rotating means comprising means for effecting incremental rotary movement of said support about 180° upon each actuation of said rotating means; and powered means for effecting linear movement of said rods with respect to said support to return said rods to a position below said slats after each actuation of said rotating means;

said apparatus further comprising a powered roller rotatable about an axis parallel to the axis of rotation of said support rotating means, and positioned so that said rods engage the periphery of said roller and are linearly powered by said roller, when said rods are rotated by said rotating means into contact therewith.

* * * * *